United States Patent [19]

Becker et al.

[11] 4,196,900

[45] Apr. 8, 1980

[54] SLIDE

[75] Inventors: Klaus Becker, Wetter; Uwe Lichtenvort, Essen; Dieter Behrmann, Hagen, all of Fed. Rep. of Germany

[73] Assignee: DEMAG Aktiengesellschaft, Duisburg, Fed. Rep. of Germany

[21] Appl. No.: 930,565

[22] Filed: Aug. 3, 1978

Related U.S. Application Data

[63] Continuation-in-part of Ser. No. 774,033, Mar. 3, 1977, Pat. No. 4,145,042.

[51] Int. Cl.[2] ..... A63G 21/10

[52] U.S. Cl. ..... 272/56.5 R

[58] Field of Search ..... 272/56.5 R, 56.5 S, 272/1 B, 32; 104/69, 70, 72, 73, 56, 57, 63, 64, 67, 134, 135, 136, 59, 86; 193/12, 13, 35 S; 182/48, 49, 176

[56] References Cited

U.S. PATENT DOCUMENTS

| | | | |
|---|---|---|---|
| 144,133 | 10/1873 | Pfund | 193/12 X |
| 485,449 | 11/1892 | Borneman et al. | 52/187 |
| 719,751 | 2/1903 | Condon | 104/56 X |
| 854,185 | 5/1907 | Traver | 104/56 |
| 1,192,445 | 7/1916 | Medart | 272/56.5 R |
| 3,083,015 | 3/1963 | Barenholtz et al. | 272/56.5 R |
| 3,879,026 | 4/1975 | Lappin, Jr. | 52/187 X |
| 3,902,948 | 9/1975 | Morros | 52/187 X |
| 4,145,042 | 3/1979 | Becker et al. | 272/56.5 R |

FOREIGN PATENT DOCUMENTS

| | | | |
|---|---|---|---|
| 2215265 | 10/1973 | Fed. Rep. of Germany | 104/56 |
| 22685 | of 1895 | United Kingdom | 104/56 |

*Primary Examiner*—Richard C. Pinkham
*Assistant Examiner*—Arnold W. Kramer
*Attorney, Agent, or Firm*—Mandeville and Schweitzer

[57] ABSTRACT

A slide is provided with a simplified support construction involving a reduced number of parts at reduced cost. Also, the appearance of the slide is improved by placing a substantial portion of the reduced support directly under the slide path. Each slide path may include only four vertical supports with the slide supported on those supports with only four cantilevered brackets. The brackets hold four girder segments extending end-to-end directly under the slide path.

26 Claims, 15 Drawing Figures

FIG. 9
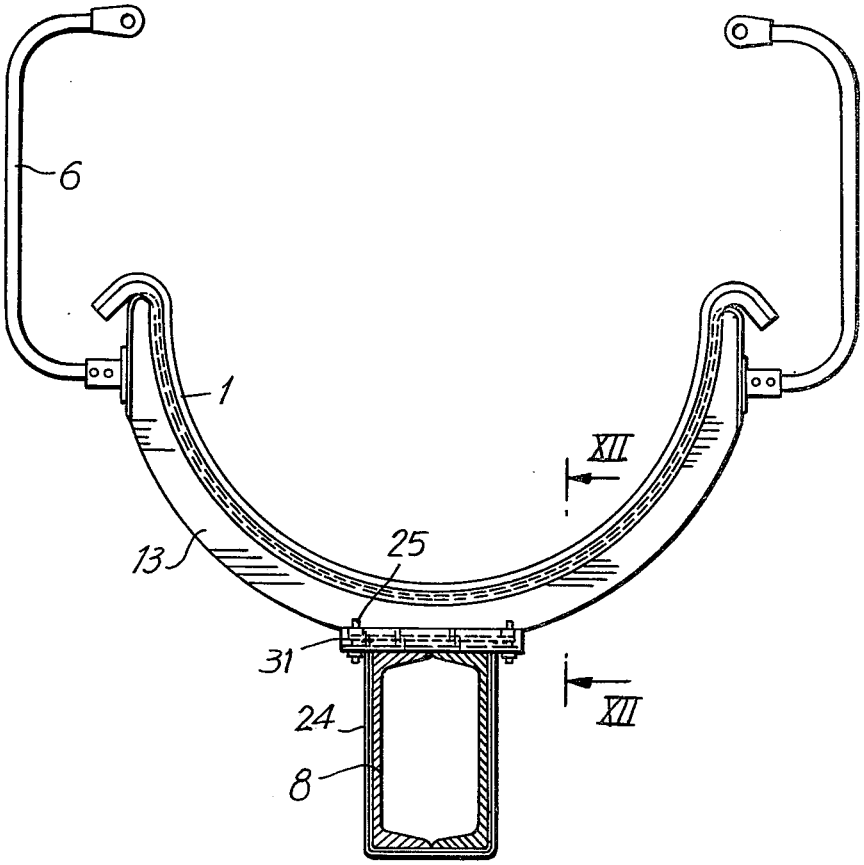
FIG. 10
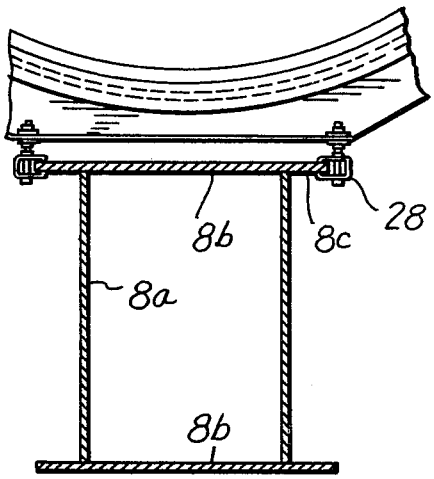
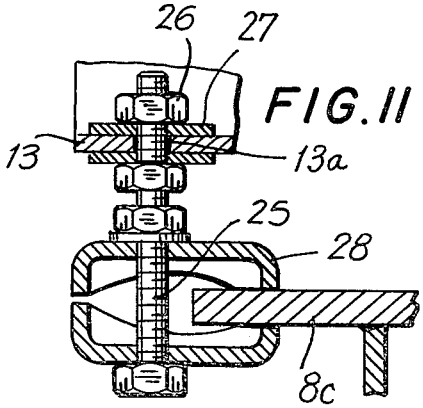
FIG. 11
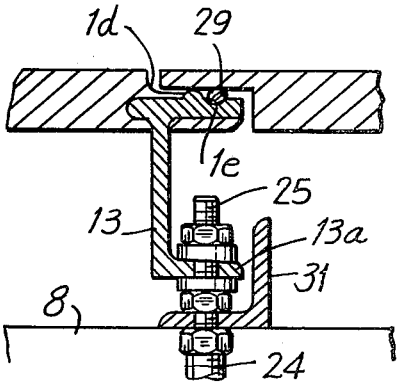
FIG. 12

SLIDE

BACKGROUND AND DESCRIPTION OF THE INVENTION

This application is a continuation-in-part of United States application Ser. No. 774,033, filed Mar. 3, 1977, now U.S. Pat. No. 4,145,042 and is hereby incorporated by reference in its entirety.

In the present application, a water slide for people is disclosed made up of at least one trough-shaped slide supported by at least one support and formed by helically or spirally coiled, and, in some cases, straight segments with sliding surfaces kept moist by water where people slide down. Such water slides may be erected as slide towers of great sliding length on a small base. The segments of the slides are supported at the ends via cantilevered brackets supported on girder segmental pieces arranged adjacent the slide, and supported by one or several vertical supports. The multitude of the brackets and the girder segmental pieces arranged next to the slide affect the appearance of the water slide and complicate the assembly. Furthermore, expenses for the water slide are high on account of the many single pieces.

It is therefore the object of the invention to simplify the structural components of the water slide and to give it a more pleasing appearance. This is done by having the slide segments supported on several segmental pieces arranged under the slide, such segmental pieces being considerably longer than the slide segments and attached to the vertical supports via cantilevered brackets.

The arrangement of the girder segments below the slide makes them barely visible, and thus they do not take away from the appearance. Furthermore, such arrangement increases safety should a slide segment break unexpectedly. This would, however, only be possible if a person were to stop on the water slide and intentionally destroy a segment. Due to the length of the segments, there are only a few brackets required leading to the vertical supports, and only a few supports.

Preferably, the girder segments are hollow profiles formed as box girders and may be curved to form an angle of 90°, approximately, as ascending space curves. Such girder segments are sufficiently warp-resistant with the hollow profile with several possible cross sections. A single water slide requires only four girder segments, four brackets, and four vertical supports which does not affect the appearance and is easy to assemble. Further, the girder segments are provided at each end with flange plates by means of which the girder segments are joined together. If deviations in the dimensions occur, spacer plates may be inserted between the flange plates.

A girder segment with a curve forming an angle of 90° in a slide with a diameter of about 12 meters has a length of about 10 meters, measured in the curve, and has a tendency toward unpleasant vibrations. To reduce the vibrations, the girder segments may be filled, at least partially, with a liquid, such as water in accordance with the invention. Tests have shown that vibrations are damped much sooner if a water filling is provided. The water may have anticorrosive and antifreeze additives. Each girder segment must have at least one opening for filling. In areas exposed to frost, each girder segment must also have a drain screw at the lowest point thereof.

The brackets consist, preferably, of box-shaped hollow profiles, and may be designed as V-shaped double brackets to shorten the support length of the girder segments. They support the girder segments at about 1 to 1.5 meters from the end and transmit the load to a common support. The vibration in a girder segment is thus transmitted to the succeeding girder segment, and via the bracket onto the support, whereby it comes to an non-critical value and is dampened.

The double brackets are arranged on the vertical supports with boreholes going through upper and lower surfaces. The boreholes exceed the diameter of the vertical supports by about 5% so that the double brackets may be pushed over the vertical supports without damaging the outer surfaces treated against corrosion. The gap between support and the boreholes may be sealed. The brackets with L-shaped stops are attached to the vertical supports, threaded sleeves for fitting screws being welded into the latter. The double brackets abut at a slant at the supports in accordance with the incline. The stops are provided with adjusting screws for the brackets which are provided at the ends with angular end pieces to attach the girder segments.

Preferably, the box-shaped girder segments have clamp surfaces for adjustably mounting supporting yokes for the slide segments consisting of synthetic material with a foamed center and solid surface layers with inner reinforcement webs. One supporting yoke is imbedded in the upper end of each slide segment where there is a recess to support the next segment. The slide segments may be sealed at the joints with a packing.

A conventional water pipe leads from a pump to the beginning of each slide. Such water pipe may include thrust nozzles at the top giving an extra push component to a person sitting there, thus making sure that a person, once boarded, does not block the slide by remaining in place.

A spiral staircase with intermediate landings leads to the upper platform at the beginning of the slide. The intermediate landings may interrupt the staircase after each 10 or 12 steps and may be inclined. The individual slides of a slide tower may be of different lengths by the direction of the boarding platform for the individual slide versus the lower pool, as the slides go in opposite directions when there is more than one in a tower.

The invention is illustrated in several specific examples shown in the drawings and described in detail in the following description.

DESCRIPTION OF THE DRAWINGS

FIG. 9 is a cross-sectional view of a slide segment with adjacent support segment;

FIG. 10 is an enlarged cross-sectional view of a portion of a slide segment showing another embodiment of the connection thereof with an adjacent support segment;

FIG. 11 is an enlarged cross-sectional view of a portion of FIG. 10;

FIG. 12 is an enlarged cross-sectional view of FIG. 9 taken along lines XII—XII thereof;

DETAILED DESCRIPTION OF THE INVENTION

Figure 1:
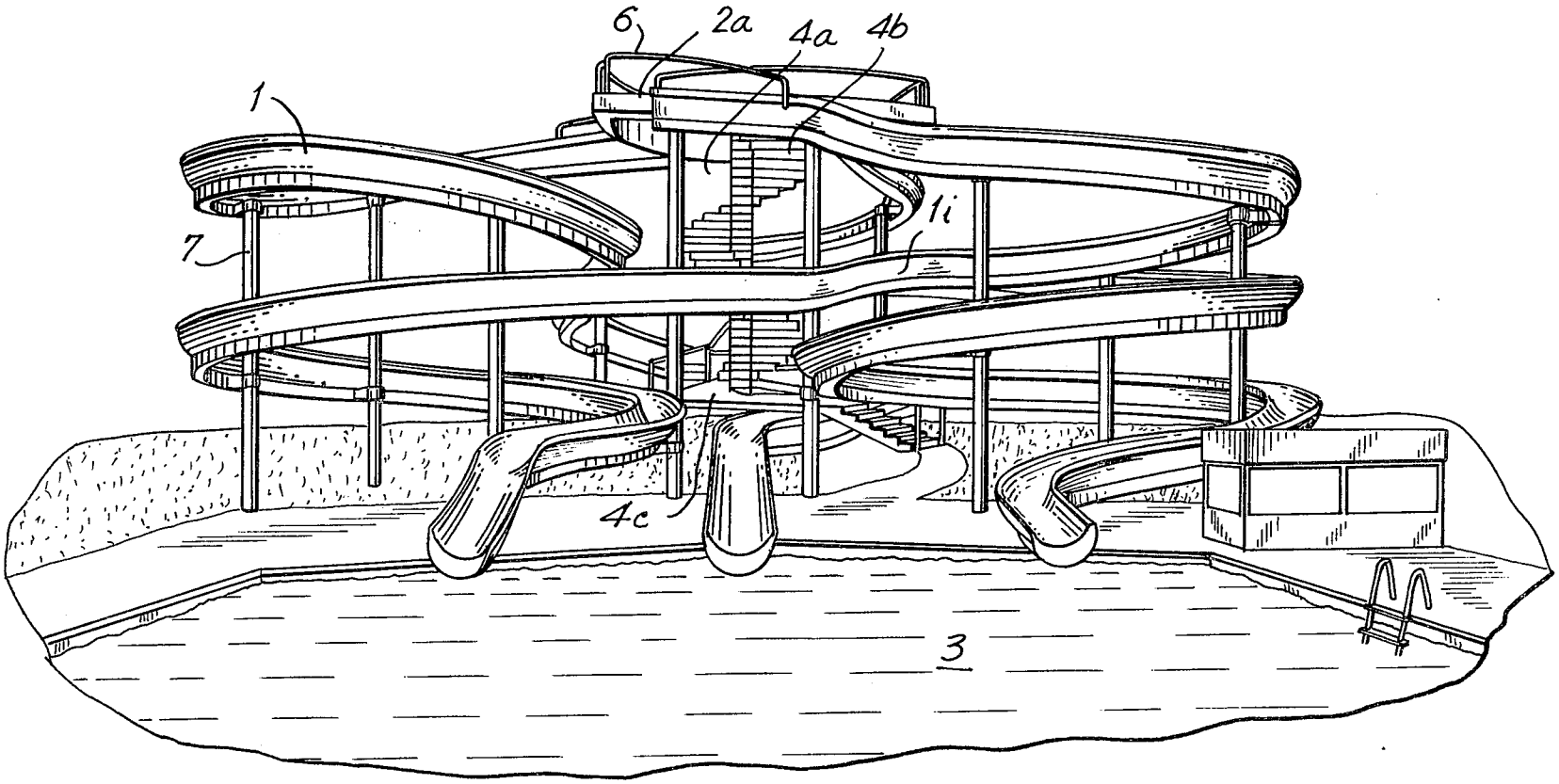
FIG. 1 illustrates a slide tower embodying the invention in which three individual slides are incorporated.

FIG. 1 shows a water slide with three slide towers of about 10 meters in height whose slides 1 end in a common pool 3. One of the slides has a short segment with extremely steep drop, a so-called jump 1*i*. The individual slides are accessible via a central spiral staircase 4*a* consisting of steps 4*b* and landings 4*c*, leading to upper platform 2*a* which may be made of concrete in warm areas. Otherwise, it may be coated with synthetic material or rubber. The water supply to the starting points of the individual slides is taken from lower pool 3 by means of one conventional pump each and one water pipe each (not shown). The drawings shows that the slide of each slide tower is carried by four vertical supports 7 only. Upper platform 2*a* and slides 1 are each provided with a railing 6. However, the latter is indicated only at the upper platform for clarity.

Figure 2:
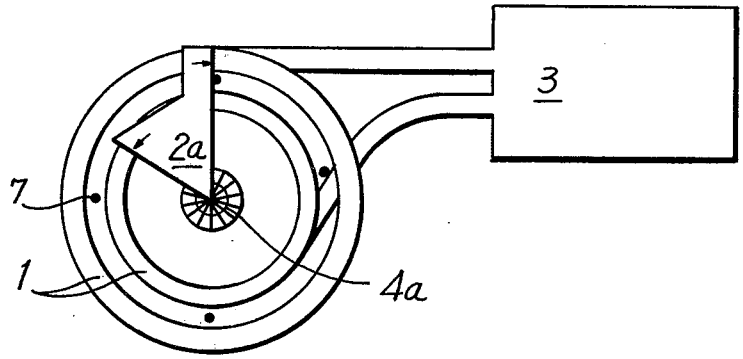
FIG. 2 is a schematic top plan view of a slide tower with a slide in accordance with the invention.

FIG. 2 is a schematic illustration of a tower water slide with inner and outer slide 1 going in opposite directions. Upper platform 2*a* may be reached by means of central spiral staircase 4*a*. In the slide tower according to FIG. 3, upper platform 2*a* is also reached via a central spiral staircase 4*a*. Slide 1A describes a large curve in the tower sketched on top followed by a small curve in the tower sketched below, while slide 1B first describes a small curve in the tower sketched above followed by a large curve in the tower sketched below, which is clearly shown on the drawing.

Figure 3:
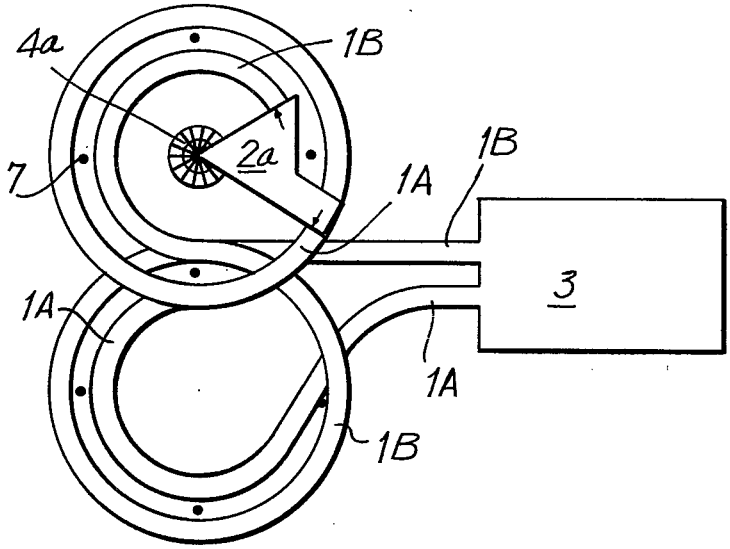
FIG. 3 is a schematic top plan view of a slide tower withh a dual slide, in accordance with the invention.
Figure 4:
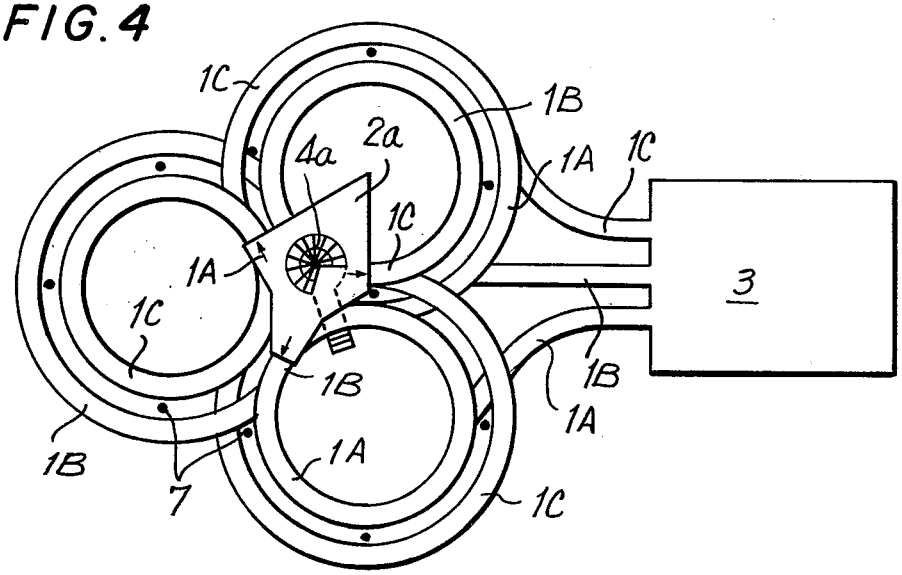
FIG. 4 is a schematic top plan view of a slide tower with a triple slide, in accordance with the invention.

In the example of FIG. 4, the spiral staircase 4*a* is arranged centrally between the slide towers as in the example of FIG. 1. The course of the individual slides 1A, 1B and 1C is shown in various locations. In FIGS. 2 through 4 each slide tower is shown with four supports 7.

Figure 5:
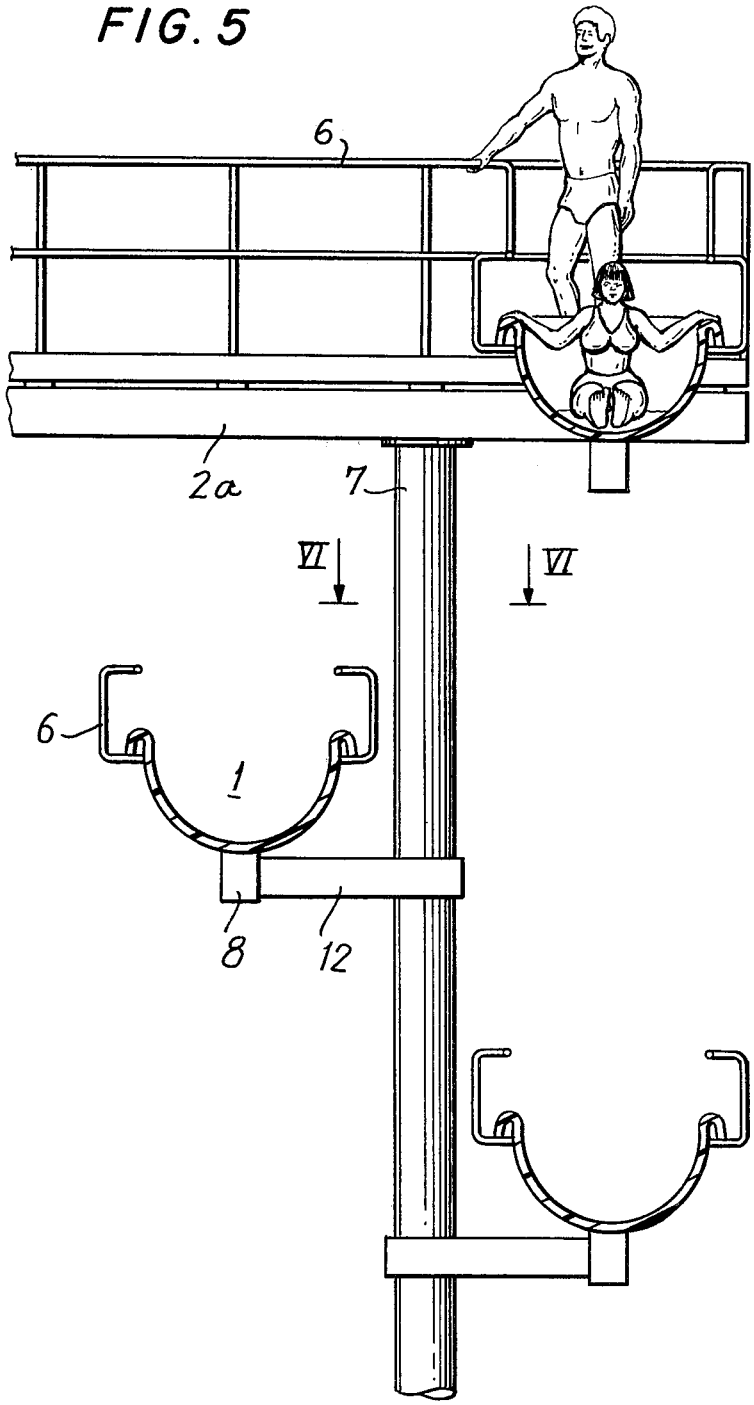
FIG. 5 is an enlarged sectional view of a slide showing the arrangement of support parts in accordance with the invention.
Figure 6:
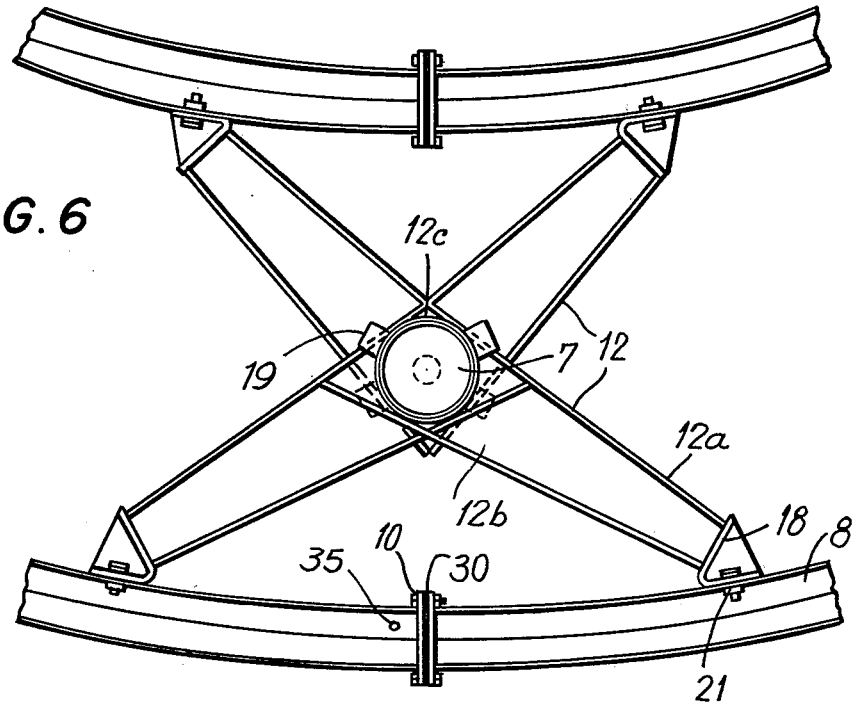
FIG. 6 is a cross-sectional view, enlarged, taken along lines VI—VI of FIG. 5.
Figure 8:
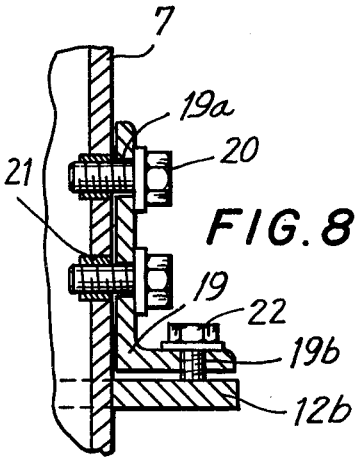
FIG. 8 is an enlarged view of a portion of the connection of FIG. 7.

FIG. 5, one of the slides is arranged on one side of support 7, and the other slide on the other side of support 7, the latter thus being uniformly weighted. Furthermore, FIG. 5 shows upper platform 2*a* with railing 6. Below slides 1 box-shaped girder segments 8 are shown supported on support 7 via cantilevered brackets 12. FIG. 6 shows a larger scale of the support of two double brackets 12 on support 7. The double brackets 12 consist of welded box girders with web plates 12*a* and protruding upper and lower flanges 12*b*. The latter are provided with a borehole 12*c* to admit the support 7, and angular end caps 18. The screw connection of angular end caps 18 on the girder segments 8 is shown in FIG. 8. Borehole 12*c* is about 15 mm larger than the diameter of support 7 and facilitates sliding the double brackets 12 onto support 7 without damaging its protective coating.

Figure 7:
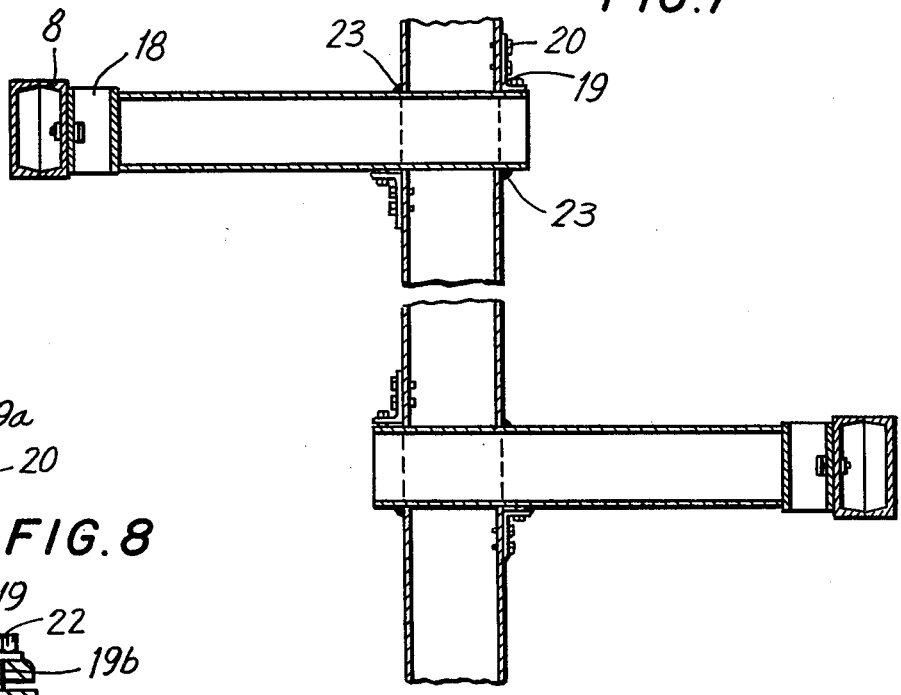
FIG. 7 is an enlarged sectional view of a portion of FIG. 5 showing the connection between the vertical supports and the cantilevered brackets.

FIGS. 6–8 show also the support of double brackets 12 at support 7 by means of stops 19. These are shapings adapted to tubular support 7, with boreholes 19*a* for fitting screws 20, for which threaded sleeves 21 are welded into support 7 (and segments 8). Stops 19 are provided with threaded boreholes 19*b* for adjusting screws 22 for adjustment of double bracket 12. The annular gap between borehole 12*c* and tubular support 7 is sealed by means of an elastic packing 23.

FIG. 9 shows a cross section of girder segment 8 consisting of two U-shaped profiles welded together to form a box girder. This may be filled with water to absorb vibrations. The water may have additives such as anticorrosives and antifreeze, if it is not drained during winter in an area subject to frost. One girder segment 8 carries four slide segments 1, each via one supporting yoke 13, which may be attached to girder segments 8 at any required location by means of a clamp yoke 24 in the form of a round bar, and a clamp angle 31. Besides being cast with slide segment 1, the supporting yoke 13 also serves to attach railing 6.

The example of FIG. 10 shows girder segment 8 consisting of web plates 8*a* and upper and lower flanges 8*b* protruding past web 8*a*. Clamp plates 28 are pressed against protruding clamp edges 8*c* by means of the previously mentioned clamp screws 25, as shown in FIG. 11. They are provided with height-adjustable clamp nuts 26 and plates 27 to carry supporting yoke 13, which has longholes 13*a* for cross displacement.

According to FIG. 12, the supporting yoke 13 in the area not cast consists of an L-profile, and has in the horizontal leg above girder segmets 8 the mentioned longholes 13*a* for cross-adjustable support at clamp angle 31. Next to the top of clamp screw 25 for height adjustment of supporting yoke 13 the thicker shank of round bar clamp yoke 24 may be seen. FIG. 12 also shows the imbedding of supporting yoke 13 in the upper end of a slide segment 1. It is reinforced in the area of supporting yoke 13 and the upper end has a step 1*d* to hold the following slide segment at its lower end. Step 1*d* features at about 10 mm from slide segment 1 a semicircular groove 1*e* for a round cord packing 29. The center of segments 1 may consist of a foamed synthetic material layer with an outside layer of solid synthetic material, reinforcement webs being imbedded in the latter.

Figure 13:
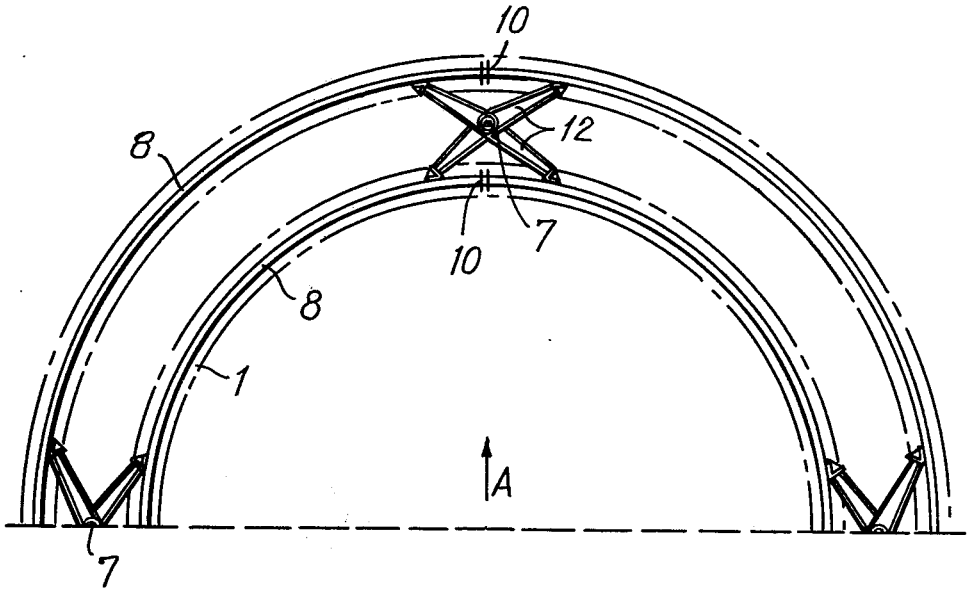
FIG. 13 is a top plan view of an arrangement of two support girder segments according to the invention.
Figure 14:
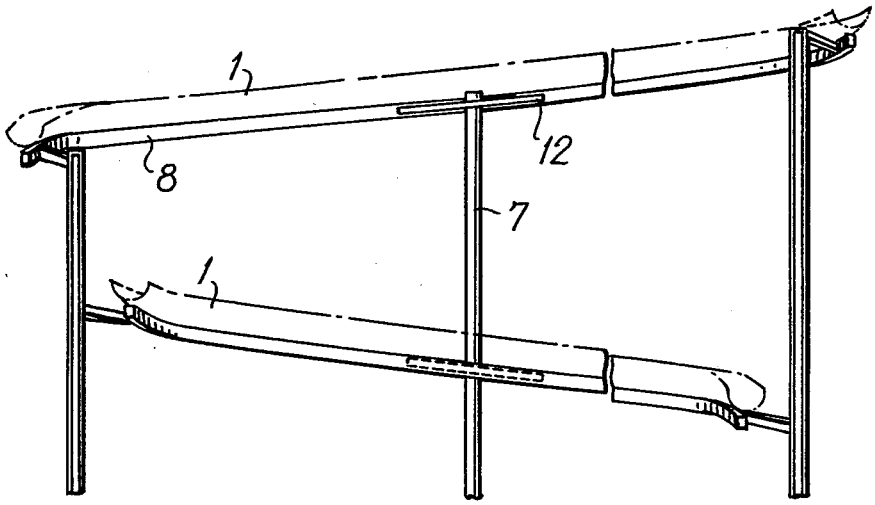
FIG. 14 is an elevational view of FIG. 13 taken in the direction of arrow A.

FIGS. 13 and 14 show two inner and two outer extremely thin girder segments 8 with a wrap angle of 90° (FIG. 13) and an incline of 9% (FIG. 14). Furthermore, FIG. 13 shows the arrangement of double brackets 12 and supports 7. Slide segments 1 are indicated in dash-dot lines.

Figure 15:
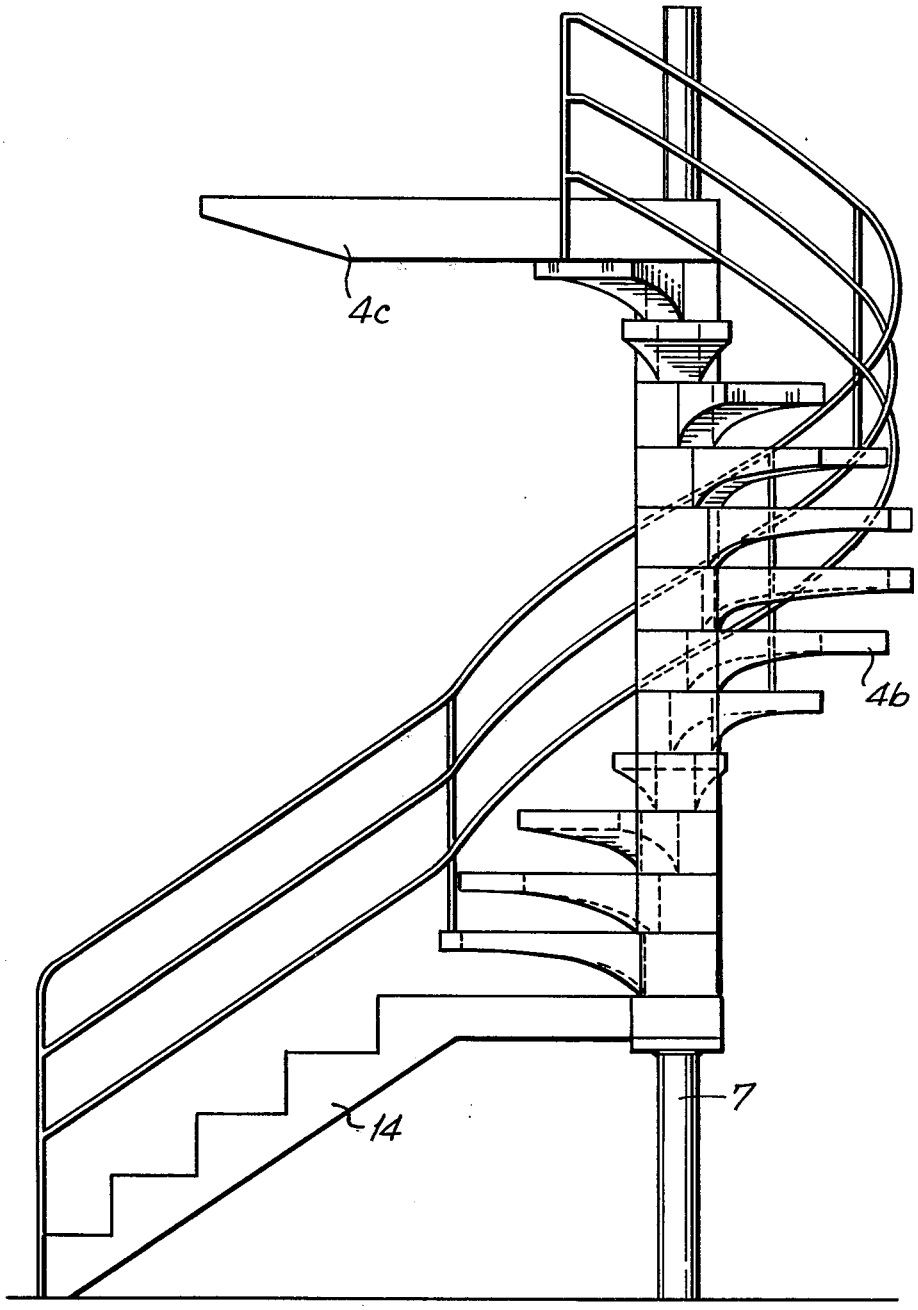
FIG. 15 is a side elevational view of a representative access staircase in accordance with the invention.

FIG. 15 shows a part of a spiral staircase with steps 4*b* attached to support 7. These are made of concrete and are provided with a borehole for arrangement at support 7. Since a slide tower may be up to 10 m high, however, a spiral staircase should not be that high. About 12 steps 4*b* are followed by landings 4*c*, or gradually ascending walkways, not shown here, followed again by more steps. A simple staircase 14 is used as a beginning.

We claim:

1. A self-supporting tower slide for people which may be assembled on any relatively level surface comprising (a) an upper slide access platform;
(b) a ground level slide exit;
(c) a continuous slide extending from said upper slide access platform to said slide exit;
(d) said slide having a semi-circular slide surface and formed with straight and curved sections; the improvement characterized by
(e) a support for said slide comprised of at least one vertical stanchion;
(f) said vertical stanchion resting on the ground and extending to said slide;
(g) a plurality of horizontal cantilevered brackets spaced along said vertical stanchion;
(h) one end of each said horizontal bracket attached to said vertical stanchion;
(i) a substantially horizontal brace extending along the path of said slide;
(j) said horizontal brace inclined to engage the bottom surface of said slide sections;
(k) said horizontal brace comprised of elongated segments of a length substantially greater than said slide sections;
(l) each said cantilevered bracket connected to said horizontal brace at the end thereof opposite said vertical stanchion; and
(m) access means extending from the ground to said upper access platform and supported on said vertical stanchion.

2. The apparatus of claim 1, further characterized by
(a) each said brace segment having a hollow profile in cross section.

3. The apparatus of claim 2, further characterized by
(a) each said hollow brace segment formed by two U-shaped parts welded together in facing relationship.

4. The apparatus of claim 3, further characterized by
(a) each said hollow brace segment having lateral connecting flanges extending from each side thereof.

5. The apparatus of claim 4, further characterized by
(a) a supporting yoke at the upper end of each slide section; and
(b) said yoke having an abutment for engagement of the lower end of the next succeeding slide section.

6. The apparatus of claim 5, further characterized by each said yoke comprising
(a) an integral horizontal extension; and
(b) means for connecting each said yoke to the adjacent brace segment.

7. The apparatus of claim 6, further characterized by said connecting means including
(a) a bore hole in said extension;
(b) a connecting bolt extending through said bore hole and connected to said adjacent brace segment; and
(c) said connecting bolt being length adjustable.

8. The apparatus of claim 6, further characterized by said connecting means including
(a) a connecting bolt extending through said bore hole;
(b) a clamp plate disposed on said connecting bolt; and
(c) said clamp plate engaging said lateral connecting flanges on the said adjacent hollow brace segment.

9. The apparatus of claim 5, further characterized by
(a) the part of each said supporting yoke engaging said slide section being embedded in said slide section.

10. The apparatus of claim 5, further characterized by
(a) railings along said slide sections; and
(b) said railings supported in said yokes.

11. The apparatus of claim 4, further characterized by
(a) angular end connecting pieces on the ends of each of said horizontal brackets; and
(b) said end pieces angled to engage the said respective brace segment.

12. The apparatus of claim 2, further characterized by
(a) each said hollow brace segment being tubular.

13. The apparatus of claim 2, further characterized by
(a) said hollow brace segments being filled with a liquid; and
(b) each said segment having at least one opening for filling.

14. The apparatus of claim 1, further characterized by
(a) at least some of said horizontal brace segments being curved;
(b) said curved segments having a wrap angle of 90°; and
(c) each said horizontal brace segment having at each end thereof a flange plate for joining adjacent segments together.

15. The apparatus of claim 14, further characterized by
(a) filler plates for insertion between the adjoining flange plates of connected together brace segments.

16. The apparatus of claim 1, further characterized by
(a) said slide sections and said brace segments inclined at an angle from horizontal of about 9°.

17. The apparatus of claim 1, further characterized by
(a) each said horizontal bracket having a hollow profile.

18. The apparatus of claim 1, further characterized by
(a) two horizontal brackets extending from said vertical stanchion at one point thereof;
(b) said two brackets being positioned to form a V; and
(c) the ends of said two brackets connected to succeeding connected together brace segments.

19. The apparatus of claim 18, further characterized by
(a) angular end connecting pieces on the ends of each of said horizontal brackets; and
(b) said end pieces angled to engage the said respective brace segment.

20. The apparatus of claim 1, further characterized by
(a) each said horizontal bracket including a borehole adjacent the end connected to said vertical stanchion; and
(b) said boreholes for receiving said vertical stanchion therein.

21. The apparatus of claim 20, further characterized by
(a) the diameter of each said borehole being 5% greater than the diameter of said vertical stanchion.

22. The apparatus of claim 20, further characterized by
(a) L-shaped flange connections disposed between each said horizontal bracket and said vertical stanchion; and
(b) said flange connections positioned on both sides of said vertical stanchion with one connected on the upper side of said bracket and one on the lower side of said bracket.

23. The apparatus of claim 22, further characterized by (a) adjusting screws on said flange connections for adjusting the connection between each said horizontal bracket and said vertical stanchion.

24. The apparatus of claim 1, further characterized by each said slide section comprising (a) a foamed internal portion of a synthetic material;

(b) solid surface portions surrounding said internal portion, said solid surface portions comprised of a synthetic material; and (c) reinforcement webs in said solid surface portions.

25. The apparatus of claim 1, further characterized by said access means comprising (a) a spiral staircase; and (b) intermediate landings in said staircase.

26. The apparatus of claim 1, further characterized by (a) water supply means extending to the top of said slide; and (b) said water supply means including water jet means at the beginning of said slide.

* * * * *